US006970676B2

(12) United States Patent
Ito et al.

(10) Patent No.: US 6,970,676 B2
(45) Date of Patent: Nov. 29, 2005

(54) IMAGING FORMING APPARATUS

(75) Inventors: Hiroshi Ito, Nagano-Ken (JP); Tatsuro Osawa, Nagano-Ken (JP)

(73) Assignee: Seiko Epson Corporation, Nagano-ken (JP)

( * ) Notice: Subject to any disclaimer, the term of this patent is extended or adjusted under 35 U.S.C. 154(b) by 41 days.

(21) Appl. No.: 10/727,995

(22) Filed: Dec. 5, 2003

(65) Prior Publication Data

US 2004/0170453 A1 Sep. 2, 2004

(30) Foreign Application Priority Data

Dec. 6, 2002 (JP) ..... 2002-354817
Jan. 10, 2003 (JP) ..... 2003-003959

(51) Int. Cl.[7] ..... G03G 15/14; G03G 15/20
(52) U.S. Cl. ..... 399/315; 399/101; 399/313; 399/314; 399/316
(58) Field of Search ..... 399/44, 66, 313, 399/314, 315, 316, 101

(56) References Cited

U.S. PATENT DOCUMENTS 5,633,703 A * 5/1997 Takenouchi et al. ..... 399/315

FOREIGN PATENT DOCUMENTS

JP 6-77170 B2 9/1994
JP 2759487 B2 3/1998

* cited by examiner

*Primary Examiner*—Hoang Ngo
(74) *Attorney, Agent, or Firm*—Sughrue Mion, PLLC

(57) ABSTRACT

The first invention is characterized that, in a transfer device of an image forming apparatus, charge removing cloth (27) is integrally attached to an attraction plate (26) for separating a transfer medium after transfer. The second invention is characterized in that, in image forming apparatus in which a transfer bias is applied between a transfer roller (15) and an intermediate transfer medium (5) by a constant-current control means (50), a leak member (40) is arranged in the vicinity of the transfer roller (15) to allow current to leak from the transfer roller to the leak member.

6 Claims, 7 Drawing Sheets

FIG. 7
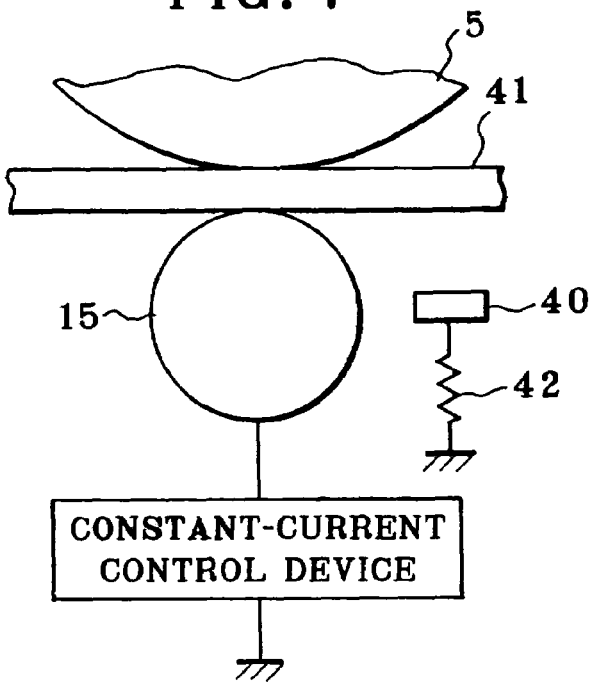
FIG. 8
| $T_0$ or less | $T_0 \sim T_1$ | $T_1 \sim T_2$ | $T_2 \sim T_3$ | --- | $T_{n-1} \sim T_n$ |
|---|---|---|---|---|---|
| $I_0$ | $I_1$ | $I_2$ | $I_3$ | --- | $I_n$ |
FIG. 9
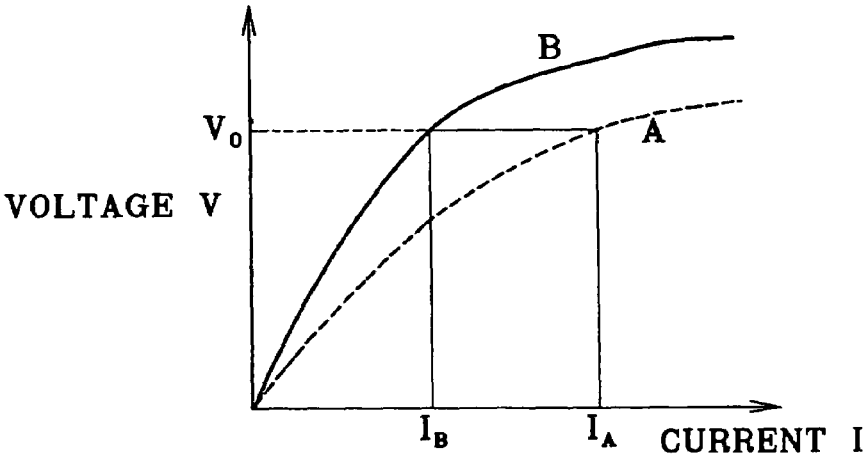

IMAGING FORMING APPARATUS

BACKGROUND OF THE INVENTION

The present invention relates to an image forming apparatus having a member for removing electric charge on a transfer medium after transfer and to an image forming apparatus in which a transfer bias is applied by constant-current control to transfer an image from an image carrier to a transfer medium.

Conventionally, in an image forming apparatus such as a copying machine, a toner image formed through developing process is transferred to a transfer paper sheet by applying transfer electric field. When there is charge on the transfer paper sheet, toner may flow and adhere to a transfer paper sheet so as to cause image deterioration. To prevent this, the charge on the transfer paper sheet is removed by a charge removal brush (Japanese Patent Publication No. H06-77170) or by a charge removal needle placed at the position just after the transfer by a transfer roller (Japanese Patent No. 2759487 (FIG. 7)).

By the way, as a transfer paper sheet after transfer is fed through a guide member in a state that the charge removal is insufficient, the transfer paper sheet may collide with ribs of the guide member so as to produce linear image irregularities due to static electricity. For example, in a color image forming apparatus employing an intermediate transfer medium, a paper sheet pressed and fed between the secondary transfer roller and the intermediate transfer medium produces paper powder due to friction during nip. Particularly, since a transfer paper sheet which has been passed through a fixing device has been greatly damaged by pressure and heat of rollers, the transfer paper sheet produces more paper powder. Such paper powder should be deposited on the charge removal brush or the charge removal needle because of long-term use, thus significantly reducing the charge removal capability. This must be a cause of image irradiation. Conventionally, to improve the charge removal capability, a voltage of a bias polarity opposite to that of the voltage of bias polarity for transfer is applied to the charge removal member. The charge removal member therefore functions as a dust collector for paper powder floating within the apparatus so that dusts adhere to the charge removal member and are difficult to be cleaned. This must be also a cause of image irregularities. However, nothing for solving the aforementioned problems is taught and disclosed in the aforementioned prior art documents.

A method for preventing the occurrence of transfer failure caused by resistance value change of a transfer member due to environmental changes has been proposed which comprises detecting temperature and relative humidity by a temperature sensor and a humidity sensor, calculating a value related to moisture content from the detected temperature and the detected relative humidity, selecting an environmental partition according to the calculated value related to moisture content and the relative humidity, and determining a transfer output value on the basis of the environmental partition (Japanese Patent Unexamined Publication No. H06-250532).

In addition, a color image forming apparatus has been also proposed which controls the constant-current value, the highest voltage value, and/or the lowest voltage value of a transfer bias applying means on the basis of temperature and humidity detected by a temperature/humidity sensor (Japanese Patent Unexamined Publication No. H11-288184).

In both the aforementioned prior art documents, however, the transfer bias control is conducted by detecting the temperature and the humidity so that there is a problem of increasing the cost because of the provision of the humidity sensor. Since the optimal bias value depends on the humidity, good bias range for a certain temperature is not ensured if there is no humidity information. This causes the transfer failure. Particularly, in case of constant-voltage control, the variation in optimal voltage according to the humidity is so large. The humidity information is absolutely necessary.

SUMMARY OF THE INVENTION

It is an object of the present invention to effectively remove charge on a transfer paper sheet and maintain the charge removal capability for long-term use.

It is anther object of the present invention to allow the transfer bias control only with temperature information without using humidity information in an image forming apparatus in which a transfer bias is applied by constant-current control.

The first invention is characterized that, in a transfer device of an image forming apparatus, charge removing cloth is integrally attached to an attraction plate for separating a transfer medium after transfer.

The second invention is characterized in that, in image forming apparatus in which an image is transferred from an image carrier to a transfer medium by applying a transfer bias between a transfer roller and the image carrier by a constant-current control means, wherein a leak member is arranged in the vicinity of the transfer roller to allow current to leak from the transfer roller to the leak member.

BRIEF DESCRIPTION OF THE DRAWINGS

FIG. 7 is an illustration for explaining the structure of a device for applying a transfer bias;

FIG. 8 is a diagram for explaining a temperature table used in a constant-current control device;

FIG. 9 is a graph for explaining transfer bias application using the constant-current control device.

DESCRIPTION OF THE PREFERRED EMBODIMENTS

Hereinafter, embodiments of the present invention will be described with reference to the drawings.

Figure 1:
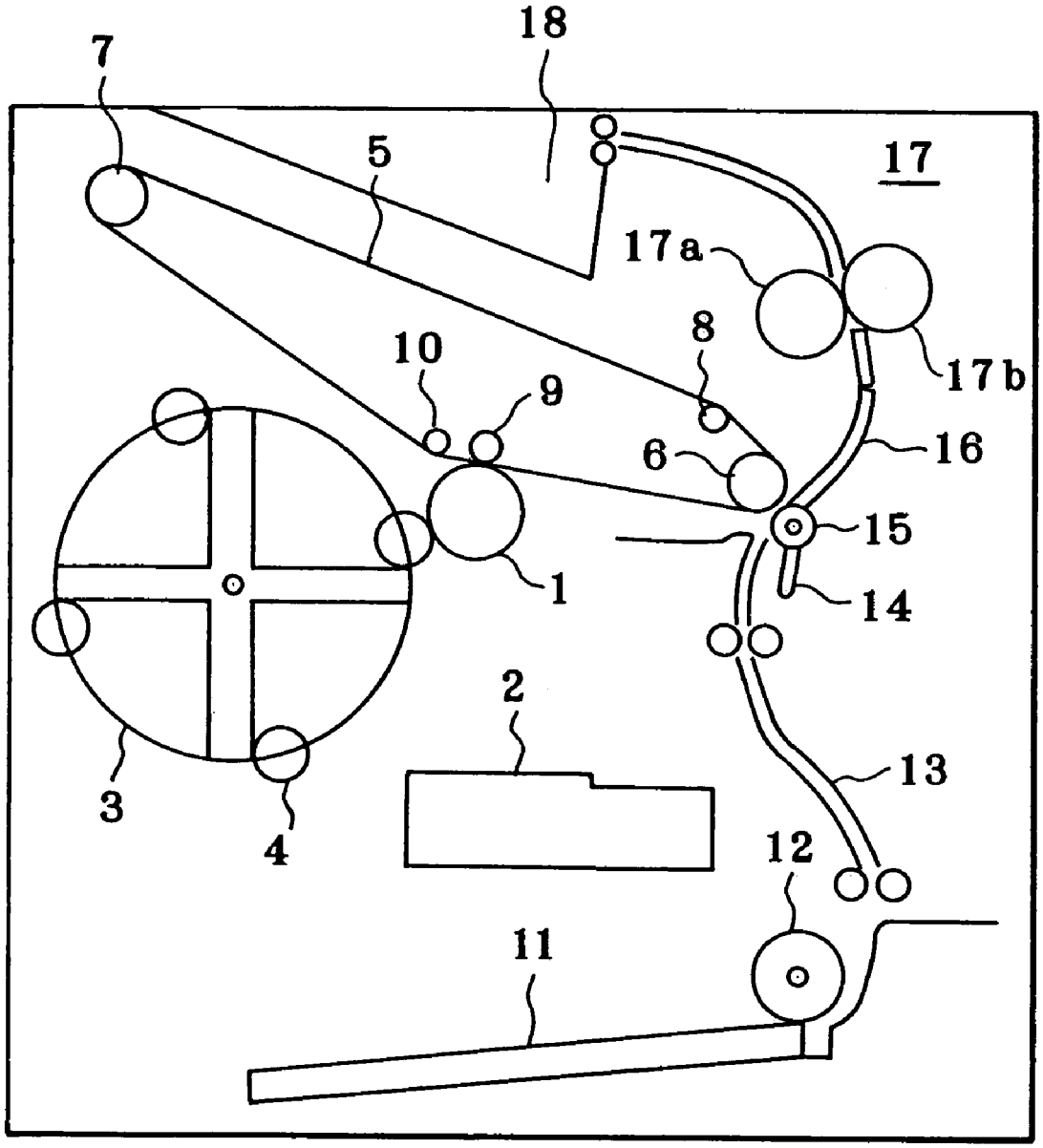
FIG. 1 is an illustration showing an example of an image forming apparatus to which an embodiment of the present invention is adopted.

FIG. 1 is an illustration showing an embodiment of an image forming apparatus to which an embodiment is adopted.

A photoreceptor 1 is uniformly charged by a charging device (not shown) and is exposed by an exposing device 2 so as to form an electrostatic latent image. A rotary-type developing device 3 for developing the electrostatic latent image has development units for four colors i.e. Y, M, C, K, having development rollers 4, respectively. Each development roller 4 is brought to a position corresponding to the photoreceptor 1 by intermittent rotation of the rotary-type developing device. At the position, the development roller 4 faces the photoreceptor 1 to develop the electrostatic latent image with toner. An intermediate transfer medium 5 is laid around a driving roller 6, a driven roller 7, a support roller 10, and a tension roller 8 with some tension and is in contact with the photoreceptor 1 at a position of a primary transfer roller 9. A toner image formed on the photoreceptor is transferred to the intermediate transfer medium 1 (primary transfer). Toner images for four colors are superposed on each other on the intermediate transfer medium.

A secondary transfer roller 15 which can be shifted to be in contact with or to separate from the intermediate transfer medium 1 by a shifting mechanism 14 is provided at a position facing the driving roller 6 (also functioning as a secondary transfer back-up roller). At this position, the toner images for the four colors on the intermediate transfer medium 1 are transferred at once (secondary transfer). That is, a paper sheet fed out by a paper feeding roller 12 from a paper sheet tray 11 is supplied to the position corresponding to the secondary transfer roller 15 through a paper feeding passage 13. During superposition of four color toner images on the intermediate transfer medium (during the primary transfer), the secondary transfer roller 15 is spaced apart from the intermediate transfer medium. On the other hand, during the secondary transfer, the secondary transfer roller 15 is in contact with the intermediate transfer medium 1. By applying a transfer bias in this state, the four color toner images are transferred from the intermediate transfer medium to the paper sheet at once (secondary transfer). After the secondary transfer, the paper sheet is introduced through a paper guide 16 to a fixing device 17 comprising a fuser roller 17*a* and a pressure roller 17*b*, and is discharged onto an outfeed tray 18 on the top of the apparatus.

Figure 2:
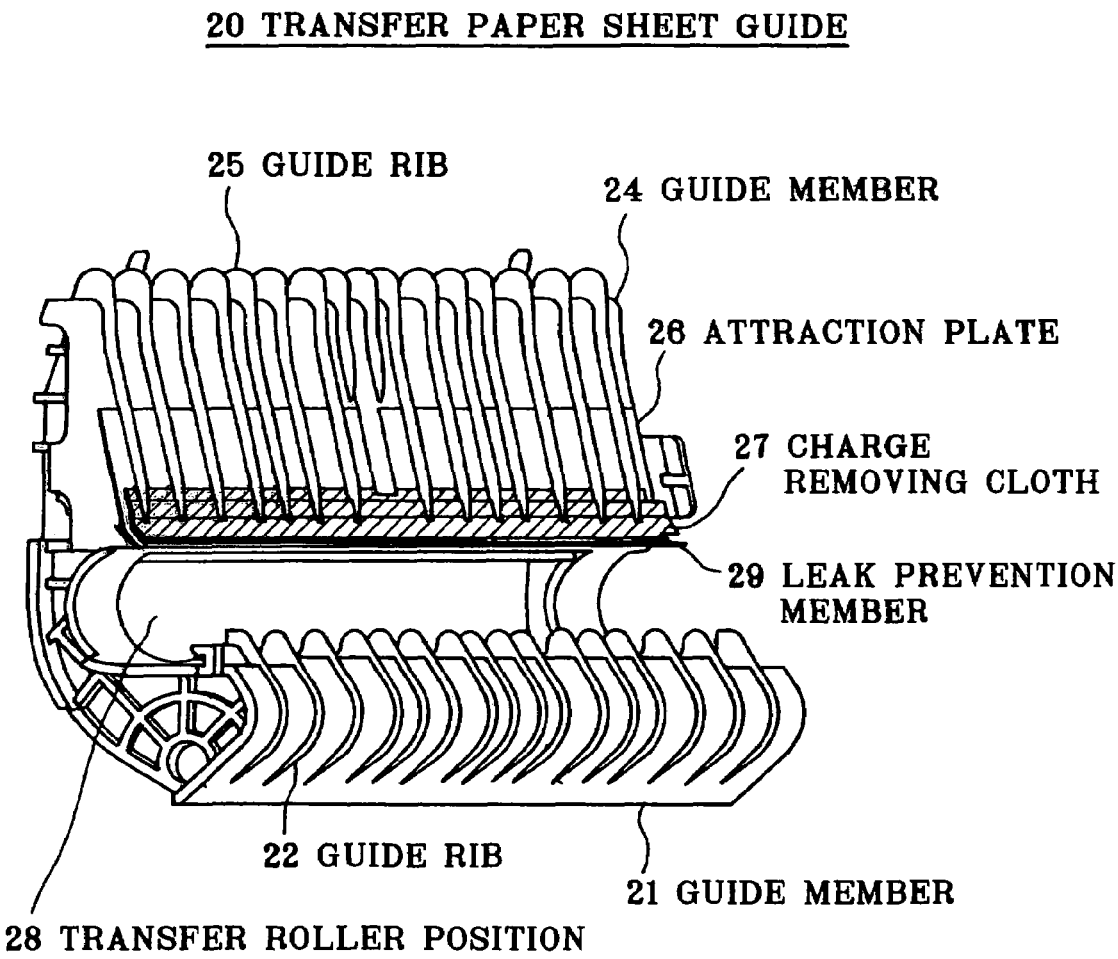
FIG. 2 is a perspective view showing a transfer paper sheet guide used in a transfer device according to this embodiment.
Figure 3:
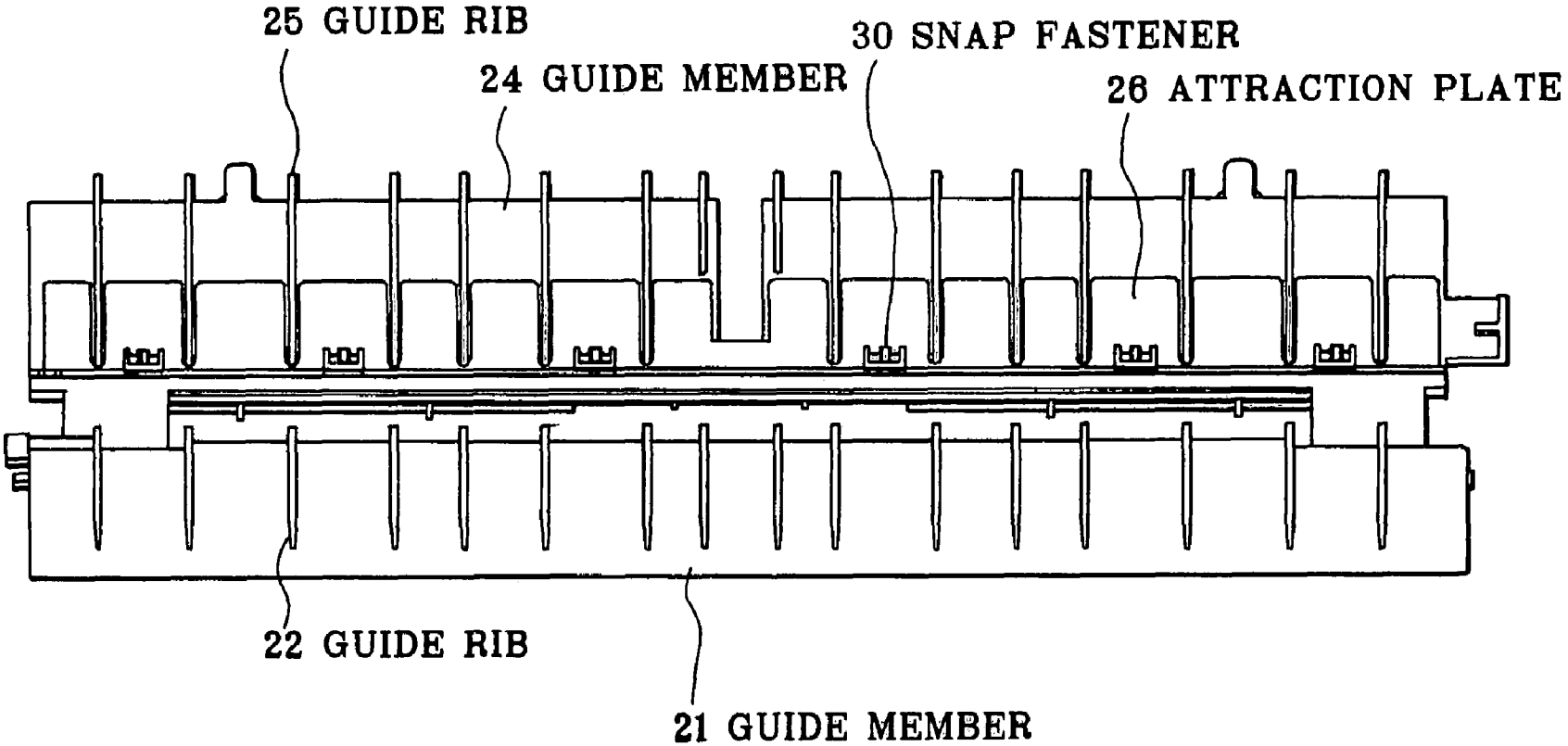
FIG. 3 is a rear plan view of the transfer paper sheet guide.
Figure 4:
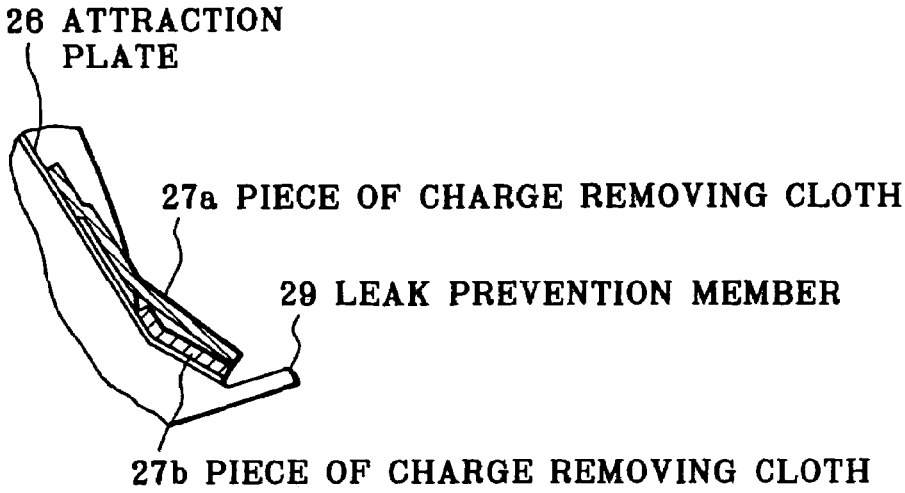
FIG. 4 is an illustration for explaining a structural example of charge removing cloth.
Figure 5:
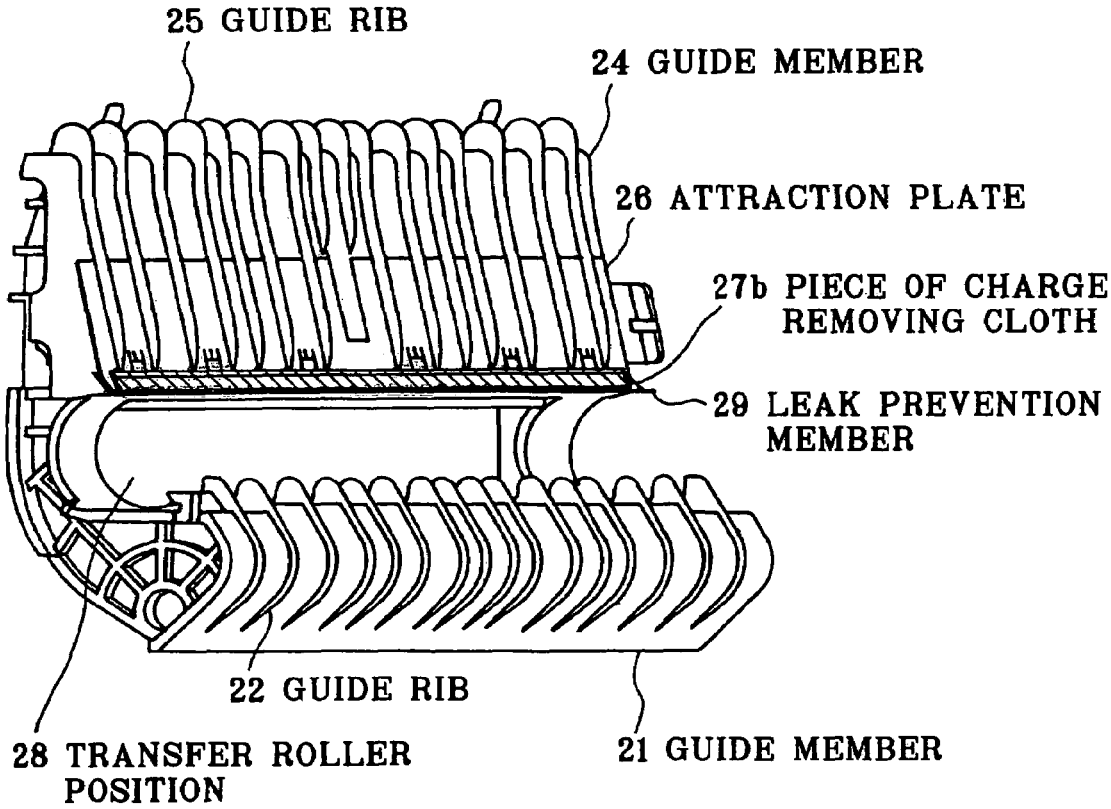
FIG. 5 is an illustration for explaining a state where the first piece of charge removing cloth is peeled off.

FIG. 2 is a perspective view showing a transfer paper sheet guide used in a transfer device according to this embodiment, FIG. 3 is a rear plan view of the transfer paper sheet guide, FIG. 4 is an illustration for explaining a structural example of charge removing cloth, and FIG. 5 is an illustration for explaining a state where the first piece of charge removing cloth is peeled off.

The transfer paper sheet guide 20 of the embodiment comprises a guide member 21 for introducing a paper sheet before the transfer to the transfer position, guide ribs 22 attached to the guide member 21, a guide member 24 for introducing the paper sheet after the transfer, and guide ribs 25 attached to the guide member 24. The secondary transfer roller (not shown) is disposed at a transfer roller position 28 between the guide member 21 and the guide member 24 wherein the secondary transfer is conducted between the secondary transfer roller and the intermediate transfer medium (not shown). An attraction plate (metal plate) 26 is provided for preventing a paper sheet after transfer from being caught by the intermediate transfer medium. Charge removing cloth 27 is bonded to the attraction plate 26 by double-sided conductive adhesive tape (metallic tape) integrally. The attraction plate 26 is structured to be detachable from the guide member 24. Therefore, the attraction plate and the charge removing cloth can be separately replaced.

A voltage of a predetermined polarity is applied from a power source (not shown) to the attraction plate 26 and the charge removing cloth 27. To prevent the occurrence of electric leak between the attraction plate 26 or the charge removing cloth 27 and the transfer roller, a leak prevention member 29 for blocking them from each other is provided. The attraction plate 26 is biased and fixed by snap fasteners 30 so that the attraction plate 26 is pressed against the leak prevention member 29.

Since the charge removing cloth 27 is nonwoven fabric made of conductive super tiny fibers such as conductive polymer, the charge removing cloth 27 have an infinite number of tips as compared with a conventional charge removing brush or charge removal needle, thereby effectively removing charge on a paper sheet. The example of the charge removing cloth shown in FIG. 4 has a double layer structure in which two pieces of charge removing cloth are superposed sequentially on the attraction plate 26 with double-sided conductive adhesive tapes so that a piece of charge removing cloth 27*b* is covered by the upper piece of charge removing cloth 27*a*. In this case, the second piece of charge removing cloth is designed not to be exposed because of the first piece of charge removing cloth and the leak prevention member 29.

Since the charge removing cloth is nonwoven fabric made of super tiny fiber, liberated toner particles adhere to the tips of fibers with time, thus deteriorating the charge removal capability of the charge removing cloth. The dirt condition of the charge removing cloth is evaluated on the basis of the number of rotation of the intermediate transfer medium, the number of times of printing, and printing duty. When it is determined that the charge removal capability has been deteriorated, the upper piece of charge removing cloth 27*a* is peeled off to expose the lower piece of charge removing cloth 27*b* for the future use. Accordingly, longer period of usage is enabled. Of cause, it is not limited to the double structure and triple layer structure is also possible.

FIG. 5 shows a state that the first piece of charge removing cloth is peeled off. As the first piece of charge removing cloth is peeled off, the second piece of charge removing cloth is exposed and can be used as a new charge removing cloth. Since the first piece and second piece are different in distance relative to the paper after transfer, there must be difference in charge removal capability in a precise sense. Therefore, it is preferable to change the resistance for the second piece to be greater than that for the first piece, or to change the bias value for charge removal to be applied to the second piece to be different from that to the first piece. Alternatively, it may adjust the height of the second piece at the same level of the first piece by taking off a spacer or the like, but not shown.

If the pieces of charge removing cloth are directly attached to each other, for example, adhesive agent of the first piece adheres to the second piece of charge removing cloth, thus reducing the charge removing capability. Therefore, a film is preferably interposed between the pieces of charge removing cloth to prevent adhesive agent from directly touching fibers of the charge removing cloth.

According to the aforementioned invention, since the charge removing cloth is nonwoven fabric made of super tiny fibers, tips of the charge removing poles are quite thin and an infinite number of the charge removing poles are formed. Therefore, the charge removal capability of the charge removing cloth is excellent beyond compare with the conventional charge removal needle. Since it has dust collecting effect, there is a drawback that paper powder is easily deposited with time. However, when it has multi-layer structure and is placed flat, it can be used for a long period of time.

Figure 6:
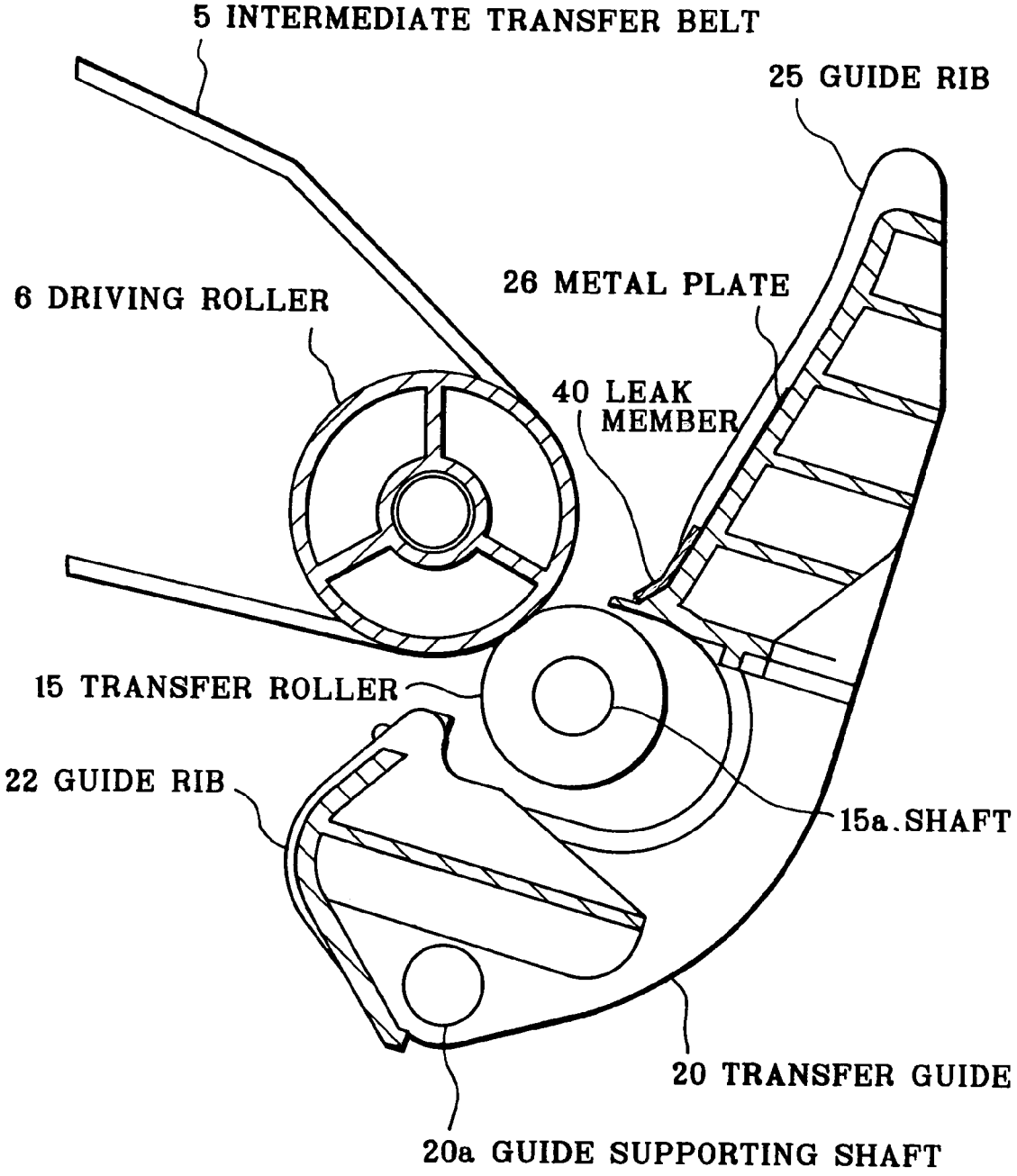
FIG. 6 is a sectional view showing main parts for explaining the structure of a transfer portion of another embodiment.

FIG. 6 is a sectional view showing main parts for explaining the structure of a transfer portion of another embodiment. An intermediate transfer belt 5 is laid around a driving roller 6 also functioning as a secondary transfer back-up roller, a driven roller (not shown), and a tension roller with some tension and is driven in a predetermined direction by the driving roller 6. A toner image is transferred (primary transfer) from a photoreceptor (not shown) onto the intermediate transfer belt 5 at a nip portion therebetween. After four color toner images are superposed on each other, the toner images are transferred to a transfer medium (not shown) at a nip portion between the intermediate transfer belt 5 and a transfer roller 15 at once. The transfer roller 15 can be shifted to be in contact with or to separate from the intermediate transfer belt 5 by a shifting mechanism (not shown) and can be rotated about a shaft 15*a* as its axis according to the rotation of the intermediate transfer belt 5 so that a transfer medium introduced through guide ribs 22 of a transfer guide 20 at a predetermined angle is nipped between the intermediate transfer belt 5 and the transfer roller 15. As will be described in detail later, a bias voltage is applied from a power source (not shown) which is controlled by constant-current control only using temperature information, thereby conducting the transfer. The transfer medium after transfer is discharged at a predetermined angle from the transfer guide 20 and is fed along guide ribs 25. An attraction plate (metal plate) 26 is provided for preventing the transfer medium after transfer from being caught by the intermediate transfer belt. A predetermined bias is applied to the attraction plate 26. The transfer guide 20 is structured to be pivotable about a guide supporting shaft 20*a*.

In this embodiment, a leak member 40 which is nonwoven fabric made of conductive super tiny fibers such as conductive polymer is arranged in the vicinity of the transfer roller 15. The leak member 40 allows electric current to leak directly from the transfer roller 15 to the leak member 40 without passing through a transfer medium when the resistance of the transfer roller 15 or the transfer medium varies according to variation in humidity. As a result, the leak member 40 makes the proper transfer bias voltage constant even when there is variation in humidity. The leak member 40 may be structured to also function as a charge removing cloth for removing charge on transfer media.

FIG. 7 is an illustration for explaining the structure of a device for applying a transfer bias, FIG. 8 is a diagram for explaining a temperature table used in a constant-current control device, and FIG. 9 is a graph for explaining transfer bias application using the constant-current control device.

A constant-current control device 50 outputs constant current according to the temperature range on the basis of a temperature table as shown in FIG. 8. In a temperature table, for example, a current value is set for every range of about 2° C. Different temperature tables are set for different kinds of paper sheets to be subjected to transfer. Electric current outputted from the constant-current control device 50 flows to the intermediate transfer belt 5 through the transfer roller 15 and a paper sheet 41 so that a required transfer bias is applied between the transfer roller 15 and the intermediate transfer belt 5.

By the way, the resistance of the transfer roller 15 and the resistance of the paper sheet 41 vary not only by variation in temperature but also by variation in humidity. Therefore, when the electric current is controlled to be a predetermined current value corresponding to a certain temperature, the transfer bias becomes different if the humidity varies. Accordingly, in this embodiment, a leak member 40 is arranged in the vicinity of the transfer roller 15. For example, by allowing electric current to partially leak through the leak member 40 when the resistance is increased due to lower humidity, the transfer bias voltage is prevented from varying and is thus set to be in a proper range. The adjustment of leaking amount is conducted, for example, by changing the distance between the leak member 40 and the roller such as by changing the projection amount of the leak member 40. In addition, a leak current limiting resistance 42 is interposed between the leak member 40 and the constant-current control device 50, thereby preventing excessive leak.

In FIG. 9, for example, characteristic A is a voltage-current characteristic for high humidity while characteristic B is a voltage-current characteristic for low humidity set in the constant-current control device. As for the characteristic A, it is assumed that in case of a current $I_A$ set for a certain temperature, a voltage $V_0$ is a proper transfer bias voltage (practically, a current smaller than $V_0$ because of the voltage drop of the transfer roller). As the humidity is lowered (characteristic B) so that the resistance of the roller and the resistance of the paper sheet are increased, leak current flows through the leak member 40 whereby the current (transfer current) flowing to the intermediate transfer belt is reduced. The current value at this point is $I_B$ so that $(I_A-I_B)$ is the leak current. While the constant current by the constant-current control device is maintained by the leak current, the transfer bias is maintained at $V_0$. In this manner, in view of the constant-current control device, the proper transfer bias voltage can be maintained while the constant current is maintained even when there is variation in humidity. Accordingly, the transfer bias control is achieved only by temperature tables without the need for humidity information.

Figure 10:
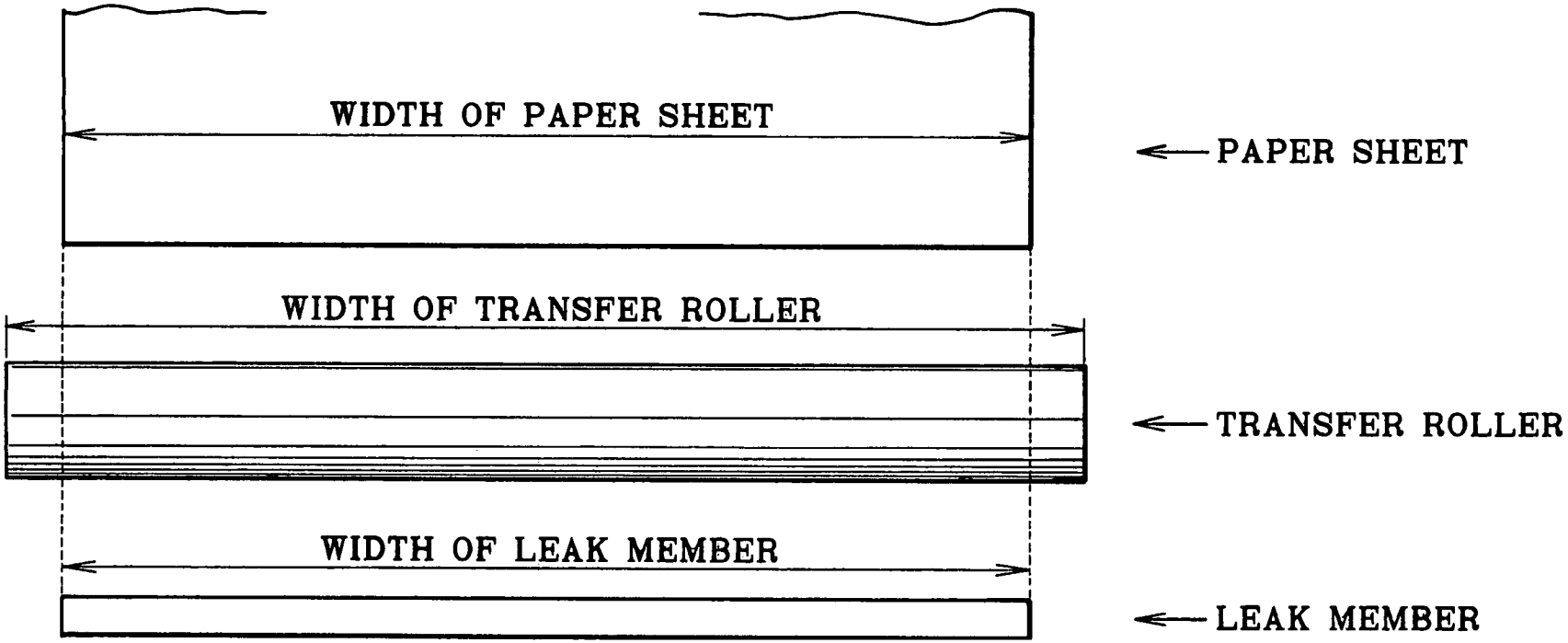
FIG. 10 is an illustration for explaining the width of a leak member.

FIG. 10 is an illustration for explaining the width of the leak member.

The leak member is arranged to face the transfer roller and to extend along the width direction of the transfer roller. In low-humidity environments, the resistance of paper sheet is large so that there is variation in surface potential thereof. Therefore, the leak member is preferably arranged to extend over the width of paper sheet or more or at least over the width of printing range or more. Since various paper sizes are normally accepted, the leak member is arranged to extend over the width of the maximum paper size or more or the width of the printing range of the maximum paper or more. In the illustrated example, the width of the leak member is equal to the width of a paper sheet. The arrangement of the leak member having such a width enables equalization of the bias voltage along the width direction and thus enables improvement of image quality.

EXAMPLE

An NBR-series sponge roller (sponge formed by foaming a material mainly consisting of NBR (nitrile butadiene rubber) and containing epichlorohydrin mixed therein) was used as the transfer roller. The roller had a resistance of $10^{7.5}$–$10^{8.0}$ Ω at a temperature of 23° C. and a relative humidity of 55%, an outer diameter of ϕ18, a rubber hardness of Asker C 30–40°, and a width of 306.5 mm. As a result, excellent transfer was obtained.

In this embodiment, in an image forming apparatus in which the transfer bias control is conducted by constant-current control, the proper transfer bias can be maintained only by using temperature information without using humidity information, thereby reducing the cost of the apparatus and also enabling excellent transfer.

What is claimed is:

1. An image forming apparatus comprising:

a transfer device; and a charge removing cloth, integrally attached to an attraction plate for separating a transfer medium after transfer;

wherein said charge removing cloth has two or more layers which are allowed to be peeled off.

2. An image forming apparatus as claimed in claim 1, wherein the layers of charge removing cloth have different resistances, respectively.

3. An image forming apparatus as claimed in claim 1, wherein the voltage to be applied to the charge removing cloth is changed every layer.

4. An image forming apparatus as claimed in claim 1, wherein a distance between the outermost layer of the charge removing cloth and the transfer medium is adjustable.

5. An image forming apparatus as claimed in claim 1, wherein a film is interposed between adjacent layers of charge removing cloth.

6. An image forming apparatus as claimed in claim 1, wherein an electrical leak prevention member is disposed between the transfer roller and the attraction plate.

* * * * *

UNITED STATES PATENT AND TRADEMARK OFFICE

CERTIFICATE OF CORRECTION

PATENT NO. : 6,970,676 B2
DATED : November 29, 2005
INVENTOR(S) : Hiroshi Ito and Tatsuro Osawa It is certified that error appears in the above-identified patent and that said Letters Patent is hereby corrected as shown below:

Title page, Item [54] and Column 1, Line 1,
Title, should read -- IMAGE FORMING APPARATUS --.

Signed and Sealed this

Eleventh Day of April, 2006

JON W. DUDAS
*Director of the United States Patent and Trademark Office*